US009968229B2

(12) United States Patent
Secchi

(10) Patent No.: US 9,968,229 B2
(45) Date of Patent: May 15, 2018

(54) HYGIENIC PROTECTOR, PARTICULARLY FOR THE COLLECTION AND SEPARATION OF HUMAN SOLID EXCREMENT

(71) Applicant: Salvatore Secchi, Pisa (IT)

(72) Inventor: Salvatore Secchi, Pisa (IT)

( * ) Notice: Subject to any disclaimer, the term of this patent is extended or adjusted under 35 U.S.C. 154(b) by 0 days. days.

(21) Appl. No.: 15/315,990

(22) PCT Filed: Jun. 5, 2014

(86) PCT No.: PCT/IT2014/000156

§ 371 (c)(1),
(2) Date: Dec. 2, 2016

(87) PCT Pub. No.: WO2015/186148

PCT Pub. Date: Dec. 10, 2015

(65) Prior Publication Data

US 2017/0095126 A1 Apr. 6, 2017

(51) Int. Cl.
*A47K 13/10* (2006.01)
*A47K 13/14* (2006.01)

(52) U.S. Cl.
CPC ..... *A47K 13/14* (2013.01)

(58) Field of Classification Search
CPC ..... A47K 13/14; A61B 10/0038
USPC ..... 4/245.1–245.9, 450–457
See application file for complete search history.

(56) References Cited

U.S. PATENT DOCUMENTS

| | | | |
|---|---|---|---|
| 2,067,958 | A | 1/1937 | Wallace et al. |
| 4,744,113 | A | 5/1988 | Kogut |
| 6,532,605 | B1 | 3/2003 | Howell |
| 2008/0263757 | A1 | 10/2008 | Samuels |

FOREIGN PATENT DOCUMENTS

| | | | |
|---|---|---|---|
| WO | 9945834 | A1 | 9/1999 |

*Primary Examiner* — Christine Skubinna
(74) *Attorney, Agent, or Firm* — King & Schickli, PLLC

(57) ABSTRACT

A hygienic protector for the collection and separation of human solid excrement, may be partially inserted into the opening of a toilet bowl, and comprises a central portion and a peripheral portion The central portion defines a container body for the collection and treatment of human solid excrement, and the peripheral portion protrudes externally with respect to the edge of the opening of the toilet bowl, and both provided in a water-soluble and biodegradable material. The container body comprises an opening shaped like the opening of the toilet bowl.

At least one anti-odor membrane extends over the central portion, to close the opening. The membrane is water-soluble, biodegradable and heat-sensitive, which is adapted to puncture upon contact with the solid excrement, substantially at the area of contact.

20 Claims, 12 Drawing Sheets

HYGIENIC PROTECTOR, PARTICULARLY FOR THE COLLECTION AND SEPARATION OF HUMAN SOLID EXCREMENT

This application is the national stage of International Patent Application No. PCT/IT2014/000156, filed Jun. 5, 2014, the disclosure of which is incorporated herein by reference.

Field of the Invention

The present invention relates to a hygienic protector, particularly for the collection and separation of human solid excrement, which is configured to be at least partially inserted in the opening of a toilet bowl, or of another device for the collection of human solid excrement, such as for example a bedpan for urine and feces.

Background of the Invention

Nowadays hygienic devices are known, made of water-soluble materials, which are accommodated, with a central portion thereof, inside a toilet bowl and which rest, with a peripheral portion thereof, on at least some of the rim of the toilet bowl, for example on at least some of the toilet seat. Such hygienic devices are used to safeguard the hygiene of the intimate parts of users of the toilet bowl, in that they prevent contact between the skin of the user and portions of the toilet bowl proper, and at the same time to safeguard the cleanliness and hygiene of the toilet bowl, in that they collect the excrement expelled by the user, thus preventing contact between these and the inner walls of the toilet bowl.

Once the user has carried out the excretion, the hygienic device that collects the excrement is allowed to fall inside the toilet bowl, where it is flushed by the flow of water, activated by the user, and conveyed to the septic tank. Once inside the septic tank, the water-soluble material of which the hygienic device is made dissolves.

Such conventional hygienic devices are however not devoid of drawbacks, among which is the fact they do not make it possible to eliminate the unpleasant odor generated by the excrement.

The lingering nature of the unpleasant odor often makes it necessary to equip bathrooms, and in particular windowless bathrooms, with ducts and extractor fans, which naturally require, in order to function, a high expenditure of energy.

Another drawback of such conventional hygienic devices consists in that they do not make it possible to optimally and completely safeguard the intimate hygiene of the users, especially for users who are particularly heavily built.

A further drawback of such conventional devices consists in that often, the flow of water activated by the user is not capable of correctly disposing of the hygienic device and the excrement that it contains, in that it tends to fill with air and float in the water contained in the toilet bowl.

The tendency of the hygienic device and of the excrement to linger in the toilet bowl obviously leads to low levels of hygiene, and forces the user to carry out multiple flushes in order to obtain the complete disposal of the hygienic device and of the excrement, with consequent evident waste of water.

Summary of the Invention

The aim of the present invention consists in providing a hygienic protector, particularly for the collection and separation of human solid excrement, which overcomes the above mentioned drawbacks relating to conventional devices.

Within this aim, an object of the present invention is to provide a hygienic protector that makes it possible to eliminate the unpleasant odor of feces.

Another object of the invention consists in providing a hygienic protector that ensures the utmost hygiene of the user.

Another object of the invention consists in providing a hygienic protector that is fast and easy to dispose of, and that thus makes it possible to reduce water consumption considerably.

Another object of the invention consists in providing a hygienic protector that can be easily adapted to the most varied types of toilet bowls, as well as to bedpans for feces and urine.

Another object of the invention consists of providing a hygienic protector that is capable of offering the widest guarantees of reliability and safety in use.

Another object of the invention consists in providing a hygienic protector that is easy to implement and economically competitive when compared to the known art.

This aim and these and other objects which will become better apparent hereinafter, are achieved by a hygienic protector, particularly for the collection and separation of human solid excrement, which is configured to be at least partially inserted into the opening of a toilet bowl, or of another device for the collection of human excrement, and comprises a central portion and a peripheral portion, said central portion defining a container body for the collection and treatment of human solid excrement, said peripheral portion being configured to protrude externally with respect to the edge of said opening of said toilet bowl, or of said bedpan, said central portion and said peripheral portion being provided in a water-soluble and biodegradable material, said container body comprising an opening that is shaped like said opening of said toilet bowl, or of said bedpan, characterized in that it comprises at least one anti-odor membrane that extends over said central portion, so as to close said opening of said container body, said anti-odor membrane being provided in a material that is water-soluble, biodegradable and heat-sensitive, which is adapted to puncture upon contact with said solid excrement, substantially at the area of contact between said at least one membrane and said solid excrement.

Brief Description of the Drawing Figures

Further characteristics and advantages of the invention will become better apparent from the description of some preferred, but not exclusive, embodiments of a hygienic protector, particularly for the collection and separation of human solid excrement, which are illustrated by way of non-limiting example with the assistance of the accompanying drawings wherein.

Figure 1:
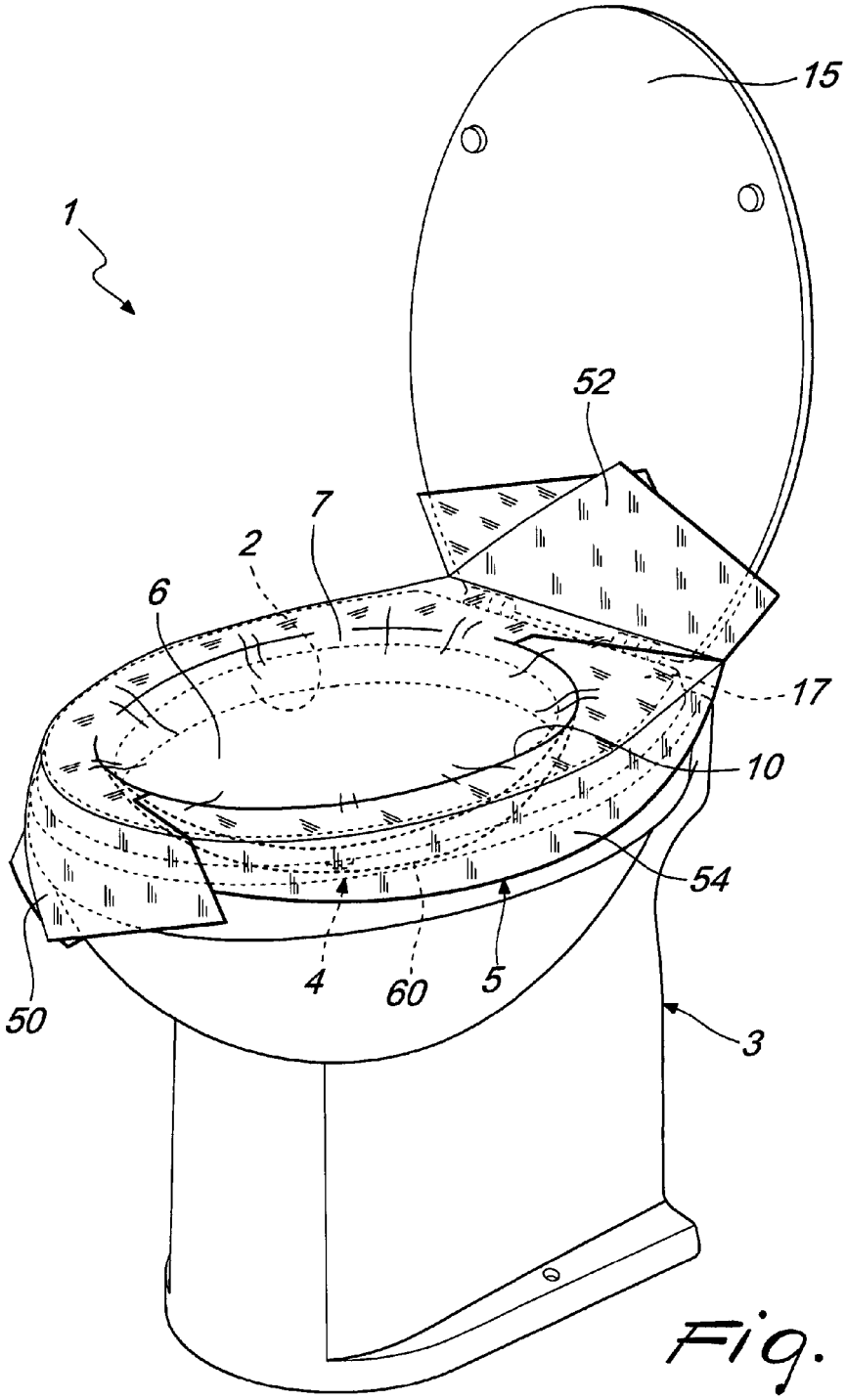
FIG. 1 is a perspective view of a first embodiment of a hygienic protector, according to the invention, applied to a toilet bowl.
Figure 2:
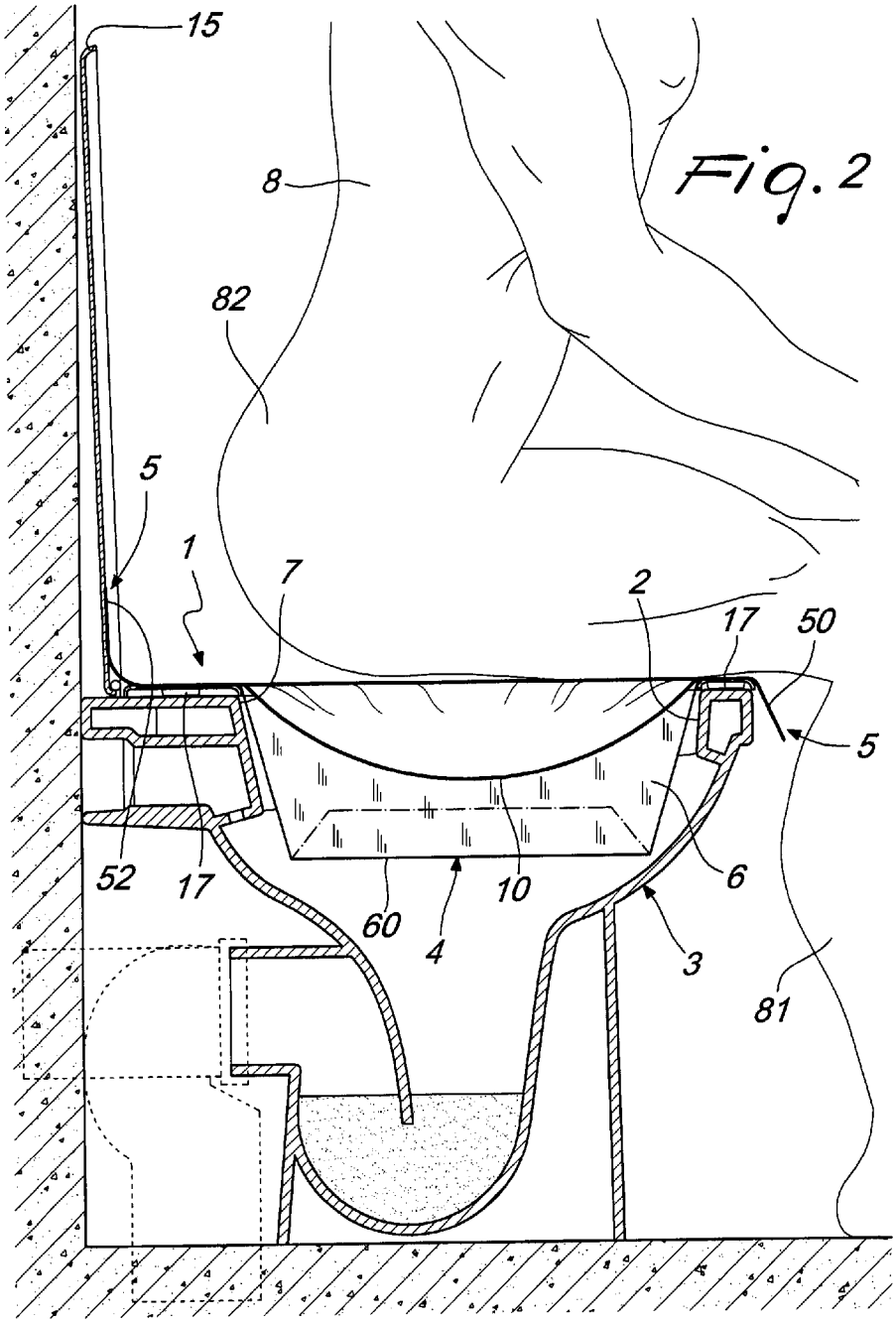
FIG. 2 is a cross-sectional side view of the hygienic protector in FIG. 1, according to the invention.
Figure 3:
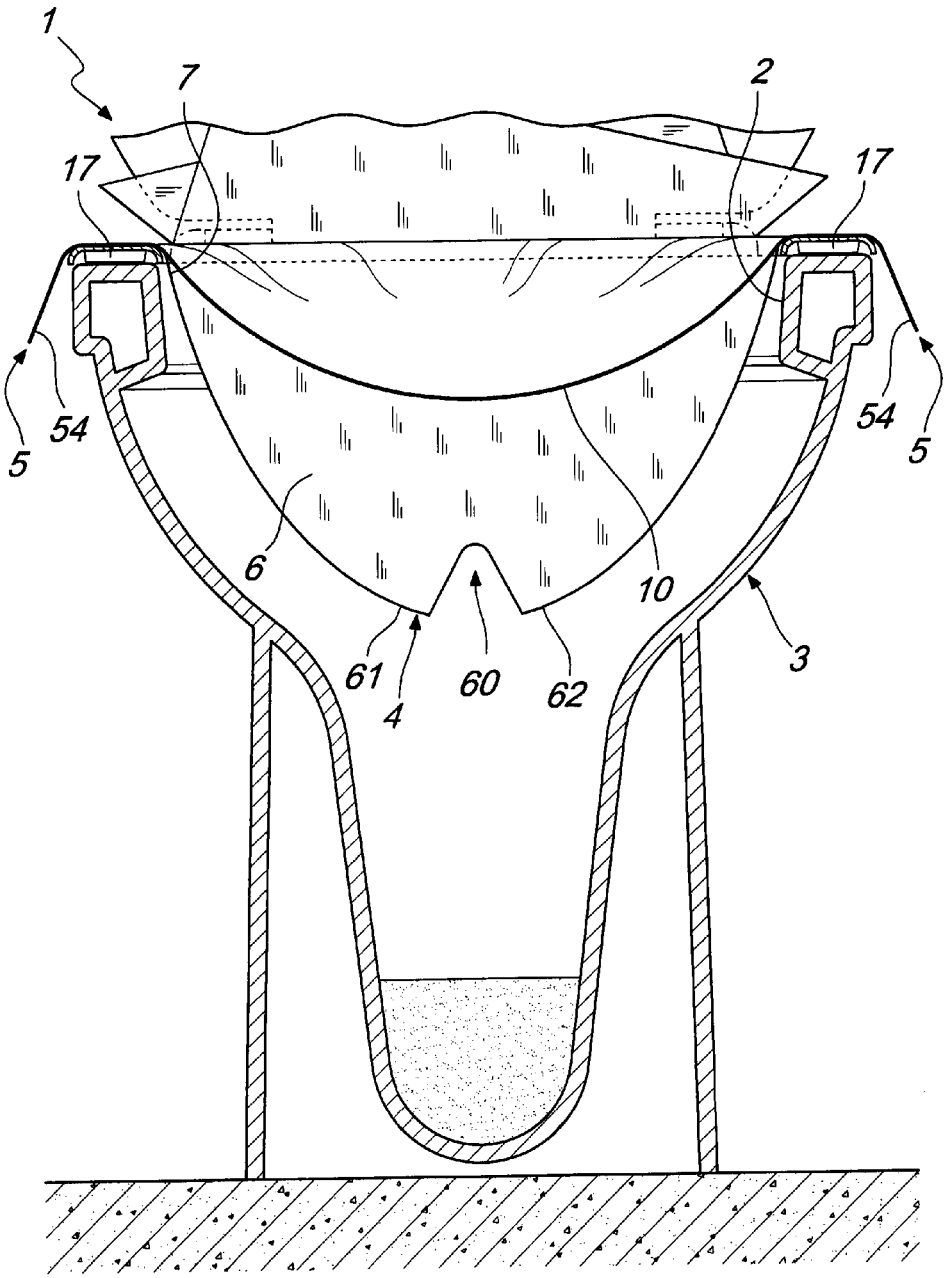
FIG. 3 is a cross-sectional front view of the hygienic protector in FIG. 1, according to the invention.
Figure 4:
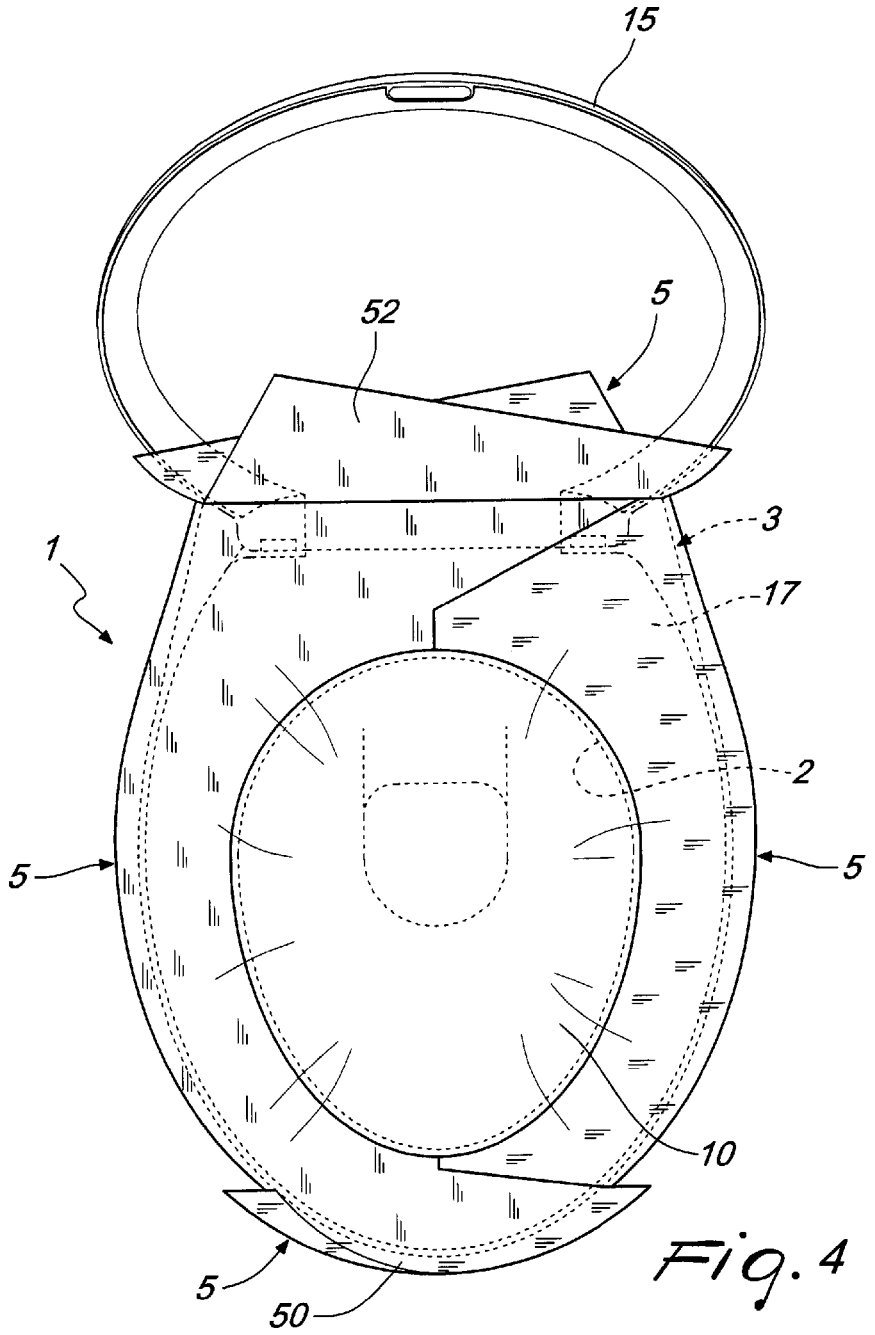
FIG. 4 is a plan view from above of the hygienic protector in FIG. 1, according to the invention.
Figure 4A:
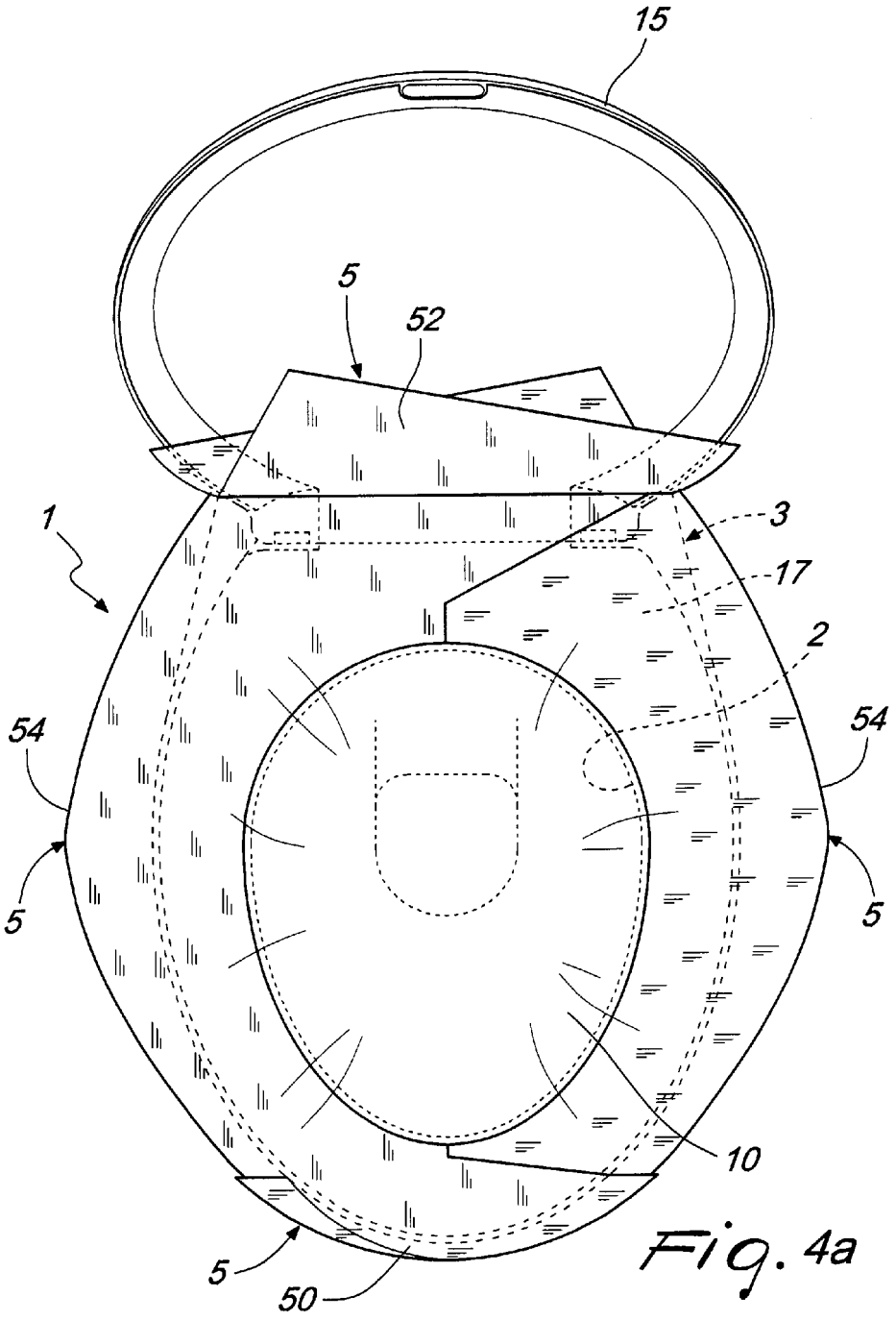
Figure 5:
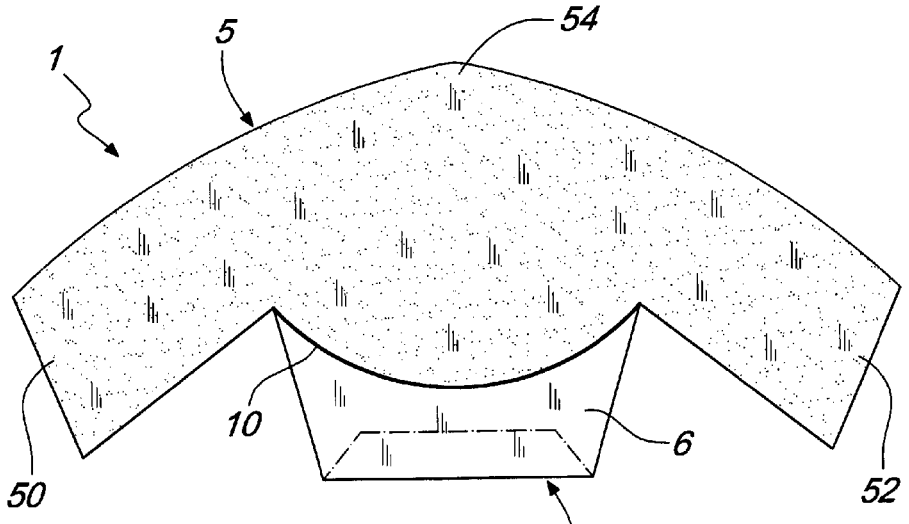
Figure 5A:
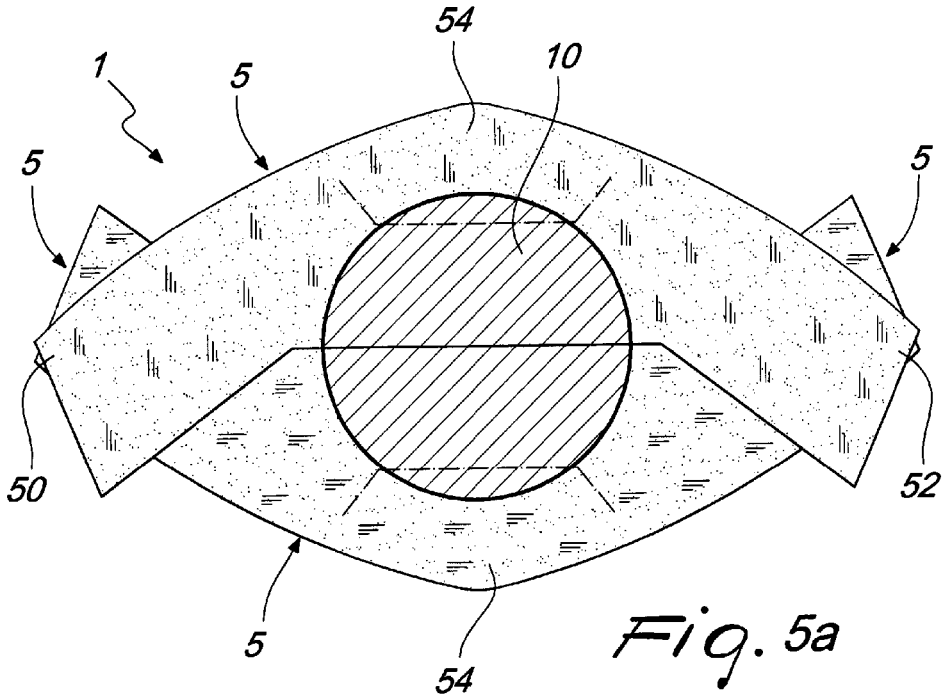
Figure 6:
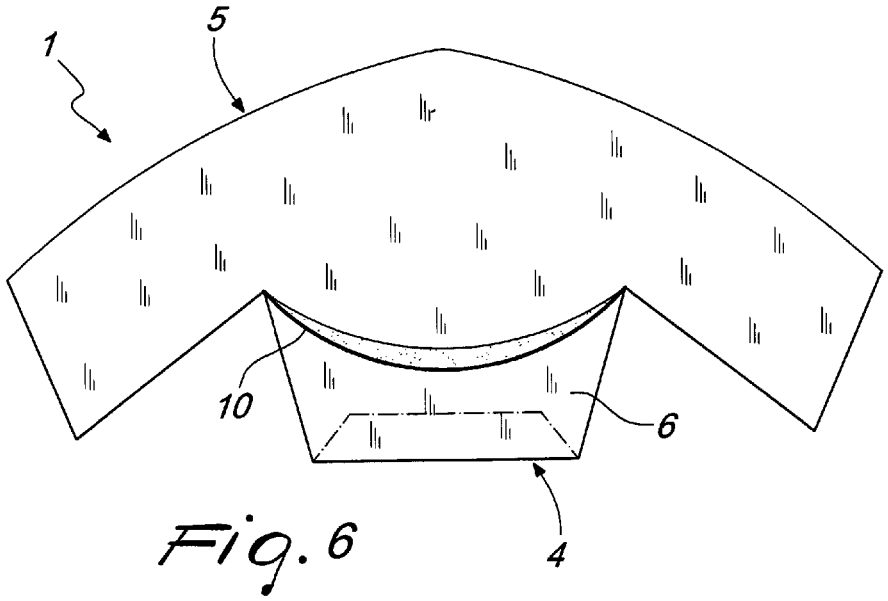
Figure 6A:
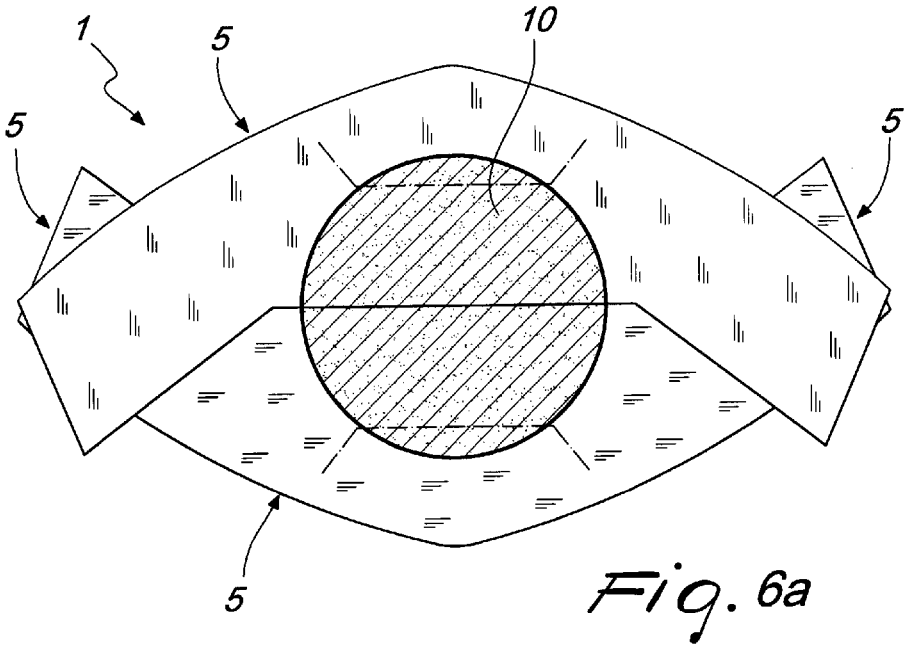
Figure 7:
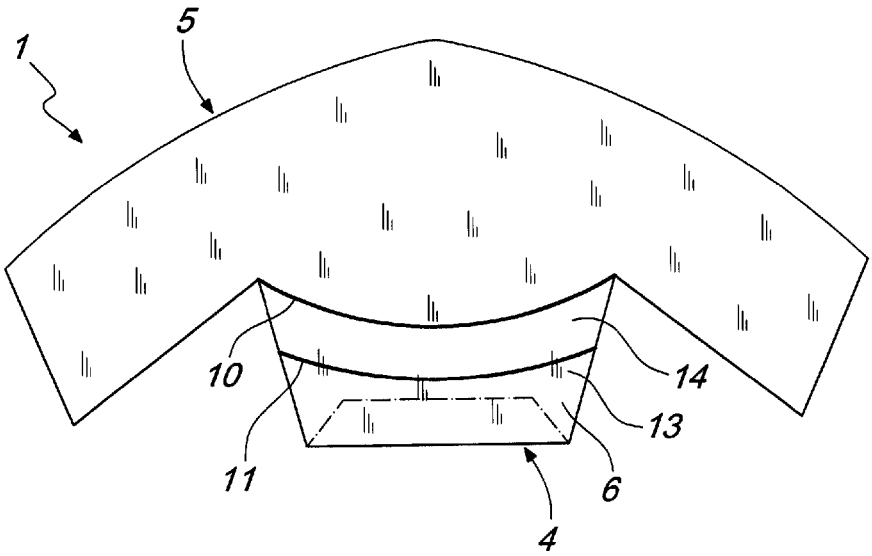
Figure 7A:
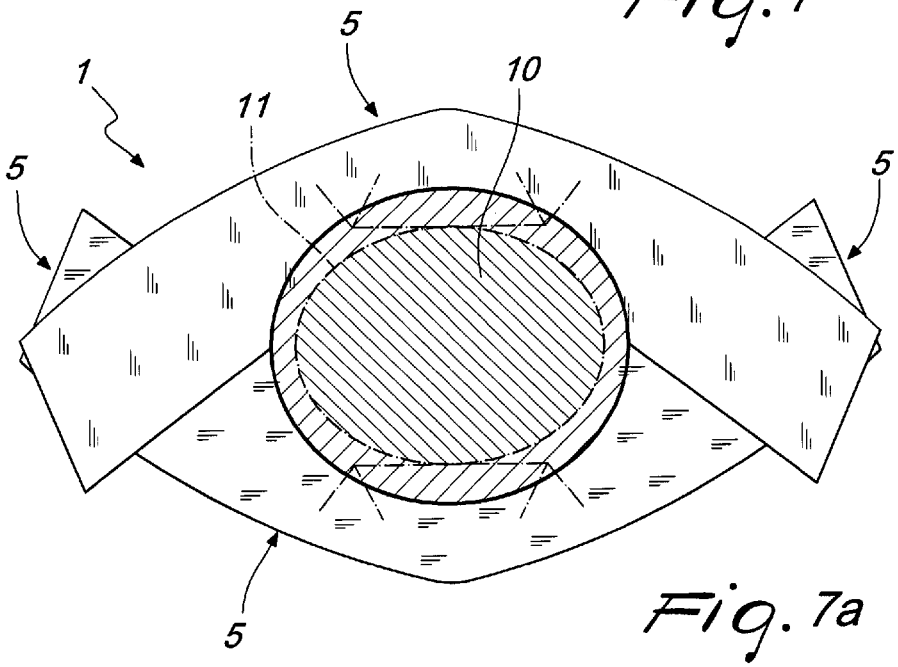
Figure 8:
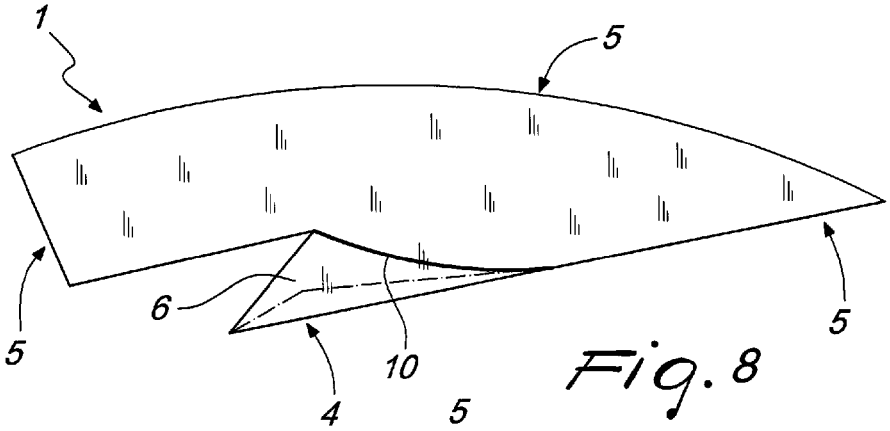
Figure 8A:
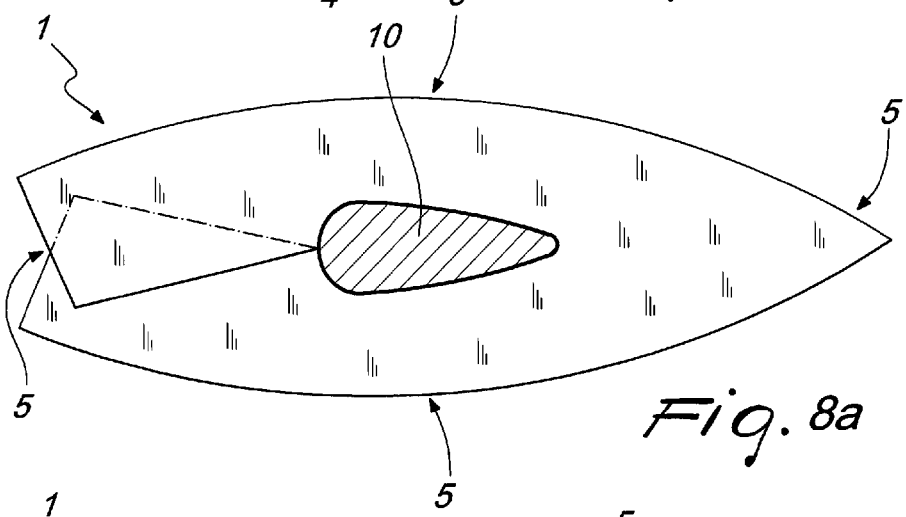
Figure 9:
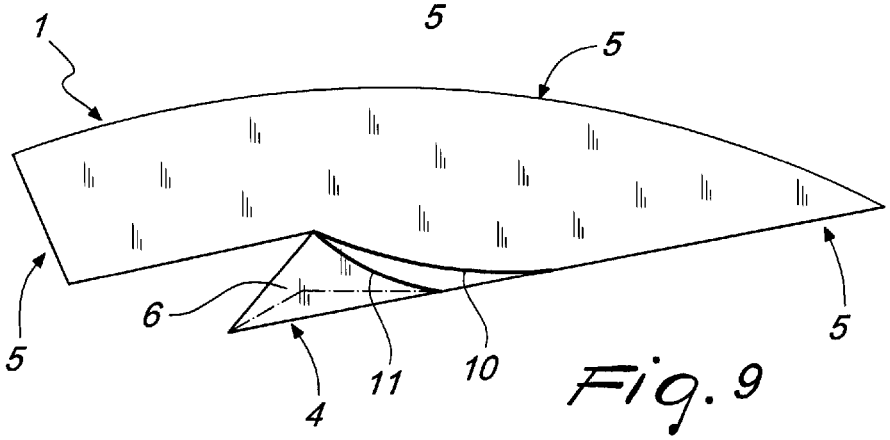
Figure 10:
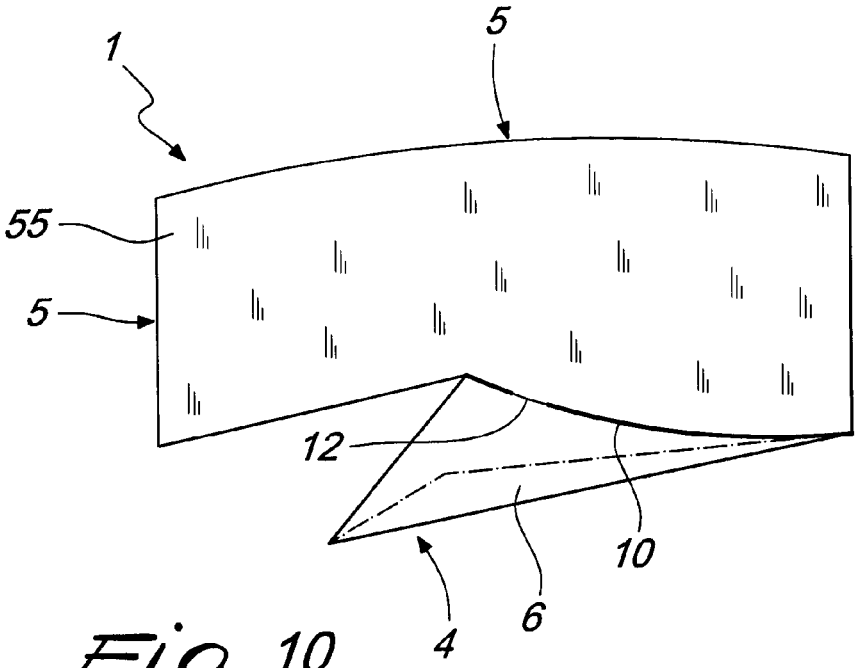
Figure 10A:
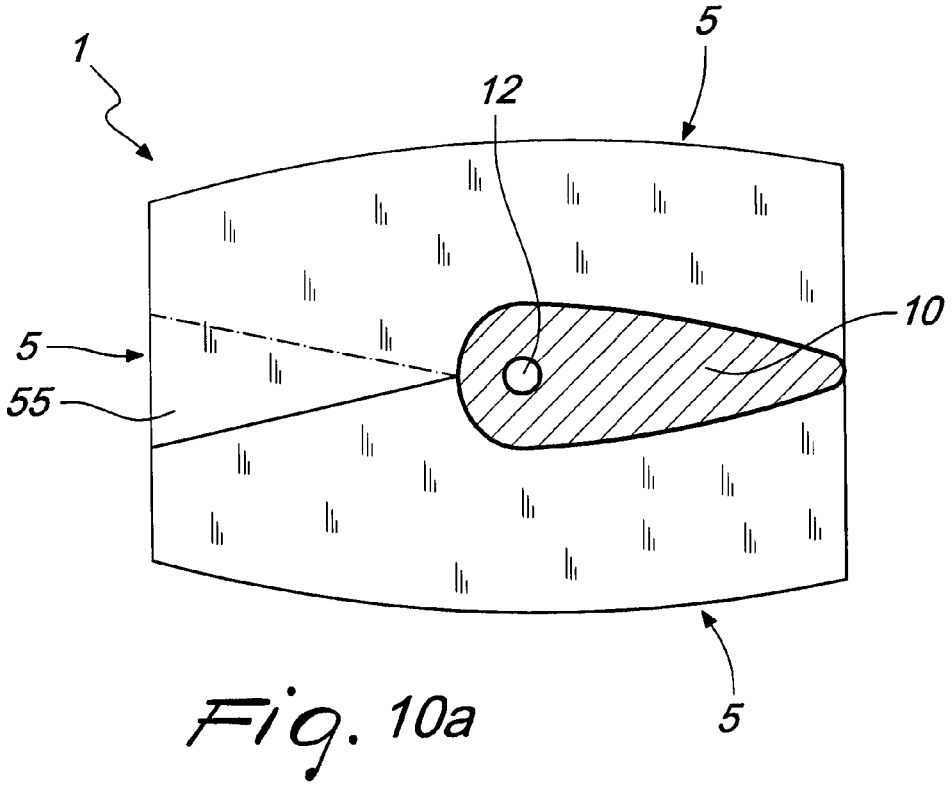
Figure 11:
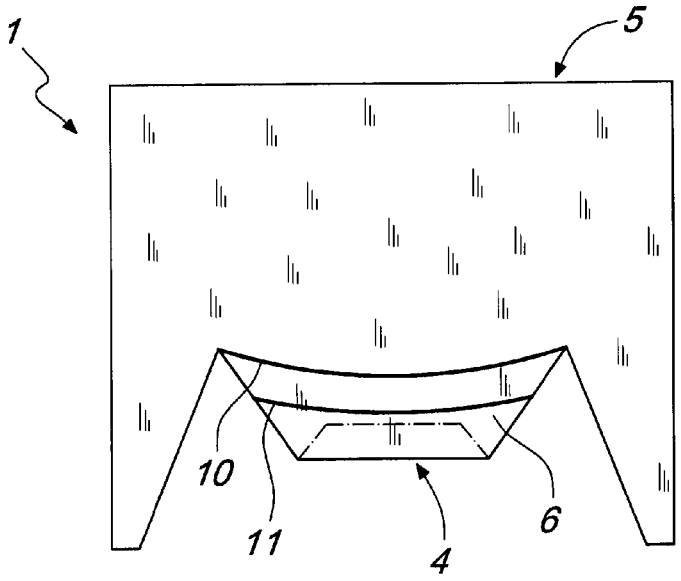
Figure 11A:
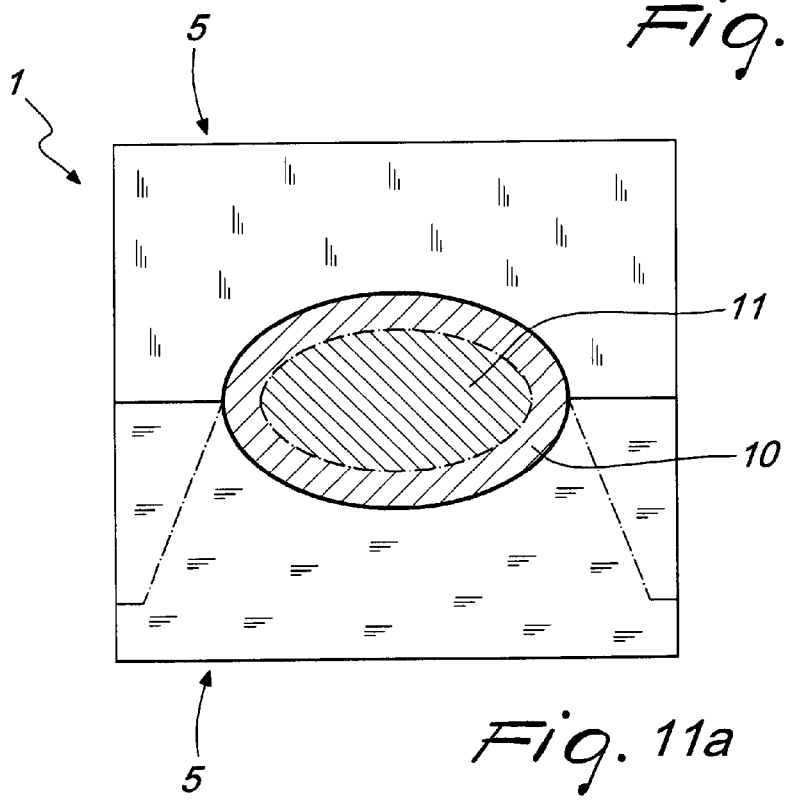
Figure 12:
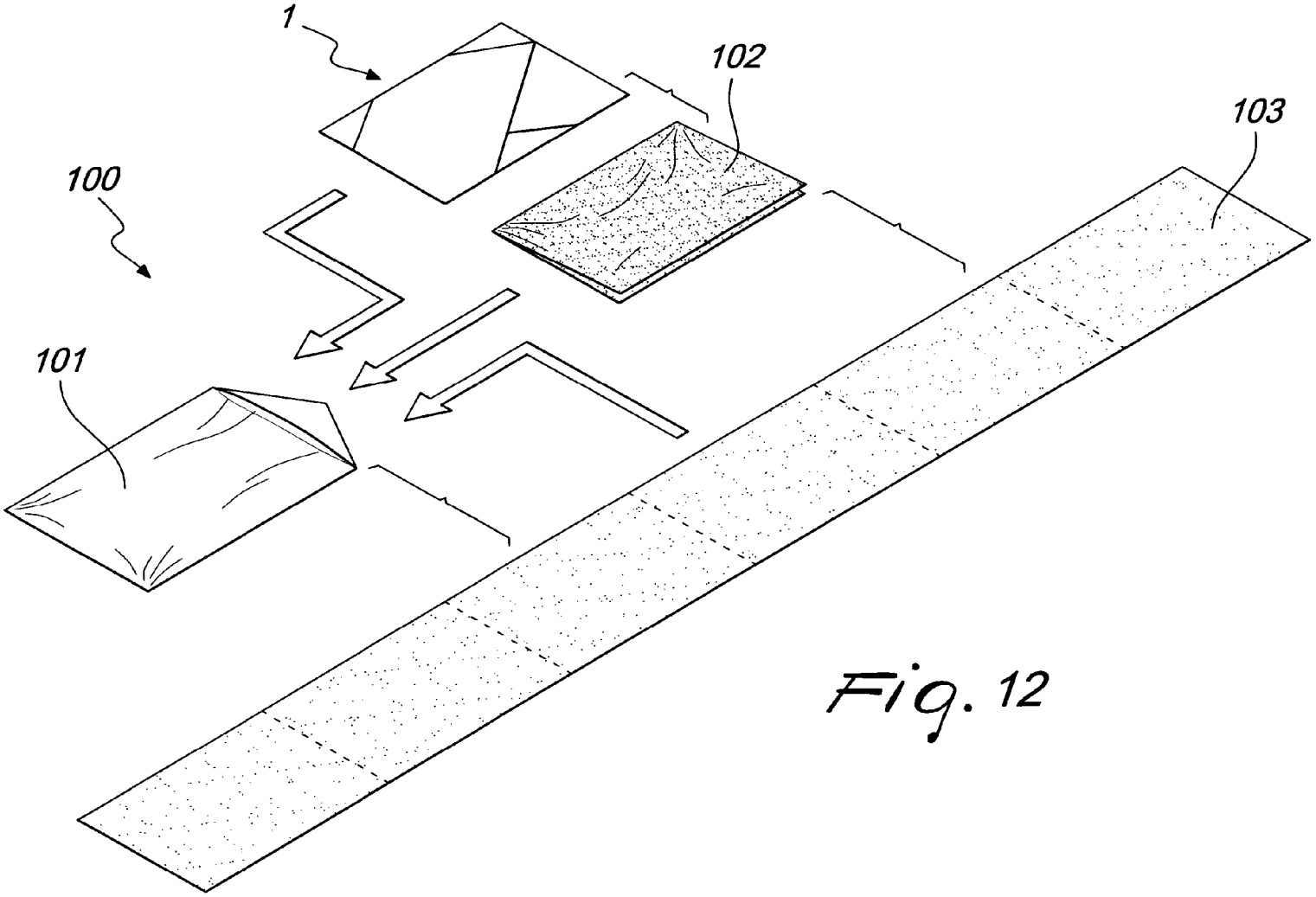

FIG. 4*a* is the same view as FIG. 4, in which the hygienic protector is shown with the side flaps opened upwardly;

FIG. 5 schematically illustrates a first embodiment of the hygienic protector, according to the invention, seen from the side, in a not fully open configuration;

FIG. 5*a* schematically illustrates the hygienic protector in FIG. 5, according to the invention, seen from above, in an open configuration;

FIG. 6 schematically illustrates a first variation of the first embodiment of the hygienic protector, according to the invention, seen from the side, in a not fully open configuration;

FIG. 6*a* schematically illustrates the hygienic protector in FIG. 6, according to the invention, seen from above, in an open configuration;

FIG. 7 schematically illustrates a second variation of the first embodiment of the hygienic protector, according to the invention, seen from the side, in a not fully open configuration;

FIG. 7*a* schematically illustrates the hygienic protector in FIG. 6, according to the invention, seen from above, in an open configuration;

FIG. 8 schematically illustrates a second embodiment of the hygienic protector, according to the invention, seen from the side, in a not fully open configuration;

FIG. 8*a* schematically illustrates the hygienic protector in FIG. 8, according to the invention, seen from above, in an open configuration;

FIG. 9 schematically illustrates a first variation of the second embodiment of the hygienic protector, according to the invention, seen from the side, in a not fully open configuration;

FIG. 10 schematically illustrates a third embodiment of the hygienic protector, according to the invention, seen from the side, in a not fully open configuration;

FIG. 10*a* schematically illustrates the hygienic protector in FIG. 10, according to the invention, seen from above, in an open configuration;

FIG. 11 schematically illustrates a fourth embodiment of the hygienic protector, according to the invention, seen from the side, in a not fully open configuration;

FIG. 11*a* schematically illustrates the hygienic protector in FIG. 11, according to the invention, seen from above, in an open configuration;

FIG. 12 illustrates a travel hygienic kit that comprises a hygienic protector, according to the invention.

Description of the Invention

With reference to the figures, the hygienic protector, particularly for the collection and separation of human solid excrement, generally designated by the reference numeral 1, is configured to be at least partially inserted into the opening 2 of a toilet bowl 3, or of another device for the collection of human solid excrement, and comprises a central portion 4 and a peripheral portion 5. The central portion 4 defines a container body 6 for the collection and retaining of human solid excrement, and is configured to be accommodated inside the opening 2 of the toilet bowl 3. The peripheral portion 5 is configured to protrude externally with respect to the rim of the opening 2 of the toilet bowl 3. The central portion 4 and the peripheral portion 5 are provided in a water-soluble and biodegradable material. The container body 6 comprises an opening 7 that is shaped like the opening 2 of the toilet bowl 3.

According to the invention, the hygienic protector 1 comprises at least one anti-odor membrane 10, 11 that extends over the central portion 4, so as to close the opening 7 of the container body 6. According to the invention, the anti-odor membrane 10, 11 is provided in a material that is water-soluble, biodegradable and heat-sensitive, which is adapted to puncture upon contact with the solid excrement expelled by the user 8, substantially at the area of contact between the anti-odor membrane 10, 11 and the solid excrement.

Advantageously, the central portion 4, which defines the container body 6, is configured to collect and retain the solid excrement for an interval of time that is sufficiently long to enable the user 8 to dispose of the hygienic protector 1, containing the solid excrement, in the septic tank.

The membrane 10, 11 advantageously has an anti-odor function, in that it prevents, or at least limits, the egress, from the container body 6, of the unpleasant odors that are generated by the excrement.

The hygienic protector 1 is advantageously made of a water-soluble and biodegradable material; however, at least the anti-odor membrane 10, 11, and possibly also the peripheral portion 5, are made of a material that, in addition to being water-soluble and biodegradable, is also heat-sensitive.

The term "water-soluble" is used here to mean a material that is soluble in water; the term "biodegradable" is used here to mean a material that undergoes biological decomposition; and the term "heat-sensitive" is used here to mean a material that is affected by the action of heat.

In other words, the hygienic protector 1 has a programmed solubility in water, in which the central portion 4 that defines the container body 6 dissolves completely in water in an appreciably longer time than the time required for the complete dissolving in water of the anti-odor membrane 10, 11 and possibly also than the time required for the complete dissolving in water of the peripheral portion 5.

Advantageously, the hygienic protector 1 is made of an ecologically compatible material, i.e. non-polluting.

Advantageously, furthermore, the hygienic protector 1 is made of a biodegradable material originating from one or more of the following products: discarded tomato skins, seaweed, sugars, potatoes and polyvinyl alcohol.

Advantageously, moreover, the anti-odor membrane 10, 11 can be made of a material that is completely soluble in water at a water temperature of at least more than 10° C.

Just as advantageously, the central portion 4, which defines the container body 6, can be made of a material that is completely soluble in water at a water temperature of at least more than 40° C.

The peripheral portion 5 of the container body 1 can be made of a material that is completely soluble in water at a water temperature of at least more than 10° C. or, alternatively, of a material that is completely soluble in water at a water temperature of at least more than 40° C.

The different temperature of complete water-solubility in water is linked both to the speed with which the material is capable of dissolving in water, and to the heat sensitivity of the material proper. In other words, a material that is completely soluble in water at a water temperature of at least more than 10° C. is adapted to puncture, almost instantly, upon contact with humid feces having a temperature of approximately 37° C., while a material that is completely soluble in water at a water temperature of at least more than 40° C. is adapted to withstand contact with humid feces having a temperature of approximately 37° C.

The material that is completely soluble in water at a water temperature of at least more than 40° C. also tends to dissolve in cooler waters, but with significantly longer time intervals.

Advantageously, both the central portion 4 and the anti-odor membrane 10, 11 are made of a material that is configured to puncture upon contact with the urine released by the user 8.

In particular, a jet of urine at 37° C. is capable of locally dissolving, practically instantly, a material that is completely soluble in water at a water temperature of at least more than 10° C., and, sufficiently quickly, also a material that is completely soluble in water at a water temperature of at least more than 40° C.

In this manner, the urine expelled by the user 8 creates one or more holes that pass through the hygienic protector 1, and in particular the anti-odor membrane 10, 11 and the central portion 4 that defines the container body 6, thus creating the conditions for evacuating the air that may accumulate inside the hygienic protector 1, and in this manner preventing the floating thereof when it is flushed by the flow of water activated by the user 8 for the disposal of the hygienic protector 1 and the excrement.

The anti-odor membrane 10, 11 can be made of a material that has a thickness comprised between 10 and 30 micrometers. Preferably the anti-odor membrane 10, 11 has a thickness of 16 micrometers.

The central portion 4 can be made of a material that has a thickness comprised between 20 and 70 micrometers, and preferably a thickness comprised between 30 and 50 micrometers.

The heat-sensitivity and water-solubility properties of the material used to make the anti-odor membrane 10, 11, or the central portion 4 that defines the container body 6 of the feces, or indeed the peripheral portion 5, also vary as a function of the thickness of the material proper, where a greater thickness confers lower heat-sensitivity and lower water-solubility.

For example, the thickness of the material used to make the central portion 4 is such as to prevent the puncturing thereof upon contact with feces, while still enabling the dissolving thereof in water in relatively long intervals of time, while the thickness of the material used to make the anti-odor membrane 10, 11 is such as to make possible an almost immediate puncturing thereof upon contact with the feces, as well as the dissolving in water in relatively short intervals of time.

Advantageously, the central portion 4 is made of a material that is configured to dissolve completely in water in a time interval comprised between 3 and 15 minutes, at a water temperature of at least more than 10° C.

Advantageously, the membrane 10,11 is made of a material that is configured to dissolve completely in water in a time interval comprised between 5 and 120 seconds, at a water temperature of at least more than 10° C.

In particular, the central portion 4 is configured to arrive at a complete dissolving only after the hygienic protector 1 has reached the septic tank, which occurs in a time interval of the order of minutes (for example between 3 and 15 minutes), while the anti-odor membrane 10, 11 must be able to puncture immediately on contact with the feces, and therefore its dissolving times in water will also be much shorter, in the order of seconds (for example between 5 and 120 seconds).

The type of basic material used to make the anti-odor membrane 10, 11, the central portion 4 and the peripheral portion 5 can advantageously be the same, if however the choice, conveniently combined, of different thicknesses and different degrees of solubility makes it possible to provide materials that have different properties of water-solubility and heat-sensitivity.

Advantageously, the central portion 4 that defines the container body 6 is made of a heat-shrink material, so that the surface of the central portion 4 upon contact with solid excrement having a temperature of approximately 37° C. contracts and wraps at least partially around that solid excrement. In this manner, the solid excrement that reaches the bottom 60 of the container body 6 will be at least partially wrapped by the material of which the central portion 4 of the hygienic protector 1 is made, thus reducing the surface of the excrement that remains in free contact with the surrounding air and thus further limiting the emanation of the miasmas generated by the excrement, in addition to what is already achieved by the anti-odor membrane 10, 11.

As shown in FIGS. 1 to 4, the hygienic protector 1 has a peripheral portion 5 that is configured, in use, to completely cover the seat surface of the toilet bowl 3. In particular, the peripheral portion 5 comprises a portion protruding at the front 50, which protrudes at the front with respect to the toilet bowl 3 so as to prevent contact between the lower limbs 81 of the user 8 and such toilet bowl 3, and a portion protruding at the rear 52, which protrudes at the rear with respect to the toilet bowl 3 so as to prevent contact between the lower back 82 of the user 8 and such toilet bowl 3 or parts thereof, such as the lid 15.

Advantageously, the peripheral portion 5 completely covers the entire upper surface of the toilet seat 17, where present.

In this manner, the user 8 is completely isolated from any accidental contact with any part of the toilet bowl 3 or parts thereof.

Advantageously, the peripheral portion 5 also comprises portions 54 which protrude laterally, which, in the configuration for use, protrude laterally with respect to the toilet bowl 3. In the configuration for use, thanks to the protruding portions 50, 52 and 54, the static and balanced positioning of the hygienic protector 1 on the toilet bowl 3 is ensured. In particular, the protruding portions 50, 52 and 54 which fall from the edges of the toilet seat 17 balance the weight of the central portion 4, thus preventing the hygienic protector 1 from falling inside the toilet bowl 3. Obviously, when the user 8 sits on the toilet bowl 3, the hygienic protector 1 is kept in position by the weight of the user 8.

Furthermore, the size of the hygienic protector 1, and the extent of the protrusion of the protruding portions 50, 52 and 54 of the peripheral portion 5 with respect to a toilet bowl 3, are such as to ensure that in any angular position in which the hygienic protector 1 is applied with respect to the toilet bowl 3, the sitting surface is always completely covered, and the intimate parts of the user are always safeguarded.

Furthermore, as shown in FIGS. 1 to 4, in use, the central part of the anti-odor membrane 10, 11 is arranged at a depth comprised in the range between 5 and 15 centimeters with respect to the seat surface of the toilet bowl 3, so as to prevent any contact between the user 8 and the solid excrement when the latter punctures the anti-odor membrane 10, 11.

Advantageously, furthermore, the bottom 60 of the container body 6 has, in cross-section, at least one V-shaped profile and preferably a W-shaped profile, designated with the reference numerals 61 and 62. The W-shaped profile is configured to convey and collect the solid excrement at a specific point, i.e. at one of the apices of such profile 61 or 62, in order to favor the at least partial wrapping of the solid excrement by the walls of the container body 6, thus reducing the surface of the excrement that remains in free contact with the surrounding air.

As illustrated by way of example in FIGS. 7 and 7*a*, with reference to to the second variation of the first embodiment of the hygienic protector 1, in FIG. 9, with reference to to the first variation of the second embodiment of the hygienic protector 1, and in FIGS. 11 and 11*a*, with reference to the fourth embodiment of the hygienic protector 1, the hygienic protector 1 comprises two anti-odor membranes 10 and 11, both of which extend over the central portion 4, so as to close the opening 7 of the container body 6, and which lie on two planes that are substantially mutually parallel.

As illustrated by way of example in FIGS. 10 and 10*a*, with reference to the third embodiment of the hygienic protector 1, the anti-odor membrane 10 can comprise a hole 12 that is configured to be passed through by solid excrement. In this manner it is possible to speed up the process of puncturing the membrane 10 upon contact with the solid excrement at 37° C., since the hole 12 already exists.

The hole 12 can also have a diameter of approximately 4 cm. Such hole 12 is sufficiently wide to allow the solid excrement to pass rapidly into the container body 6, and at the same time is sufficiently narrow to prevent the unpleasant odors generated by the solid excrement that is present in the container body 6 from spreading to the surrounding environment.

Advantageously, the container body 6 can also comprise an anti-odor substance.

According to the first embodiment, schematically illustrated in FIGS. 5 and 5*a*, the hygienic protector 1 comprises a peripheral portion 5, an anti-odor membrane 10, and a central portion 4. The peripheral portion 5 and the anti-odor membrane 10 are made of the same type of material, and in particular from a material that is water-soluble, biodegradable and heat-sensitive, which is to say, a material that is rapidly water-soluble, while the central portion 4 is made of a material that is water-soluble and biodegradable, but which is slowly water-soluble. The central portion 4, which defines the container body 6, is bonded to the edges of the anti-odor membrane 10 by way of adapted bonding lines.

Such hygienic protector 1, according to the first embodiment, is particularly adapted to be applied to toilet bowls of the type of sitting flush toilets.

The method for providing the hygienic protector 1 illustrated in FIGS. 5 and 5*a* comprises the steps of:

- arranging two first sheets made of a water-soluble, biodegradable and heat-sensitive material, mutually superimposed;
- cutting the two first sheets so as to define the peripheral portion 5 and so as to provide the anti-odor membrane 10;
- arranging a second sheet made of a water-soluble and biodegradable material;
- cutting and bonding the second sheet so as to provide the central portion 4 which defines the container body 6;
- bonding the edges of the anti-odor membrane 10 along the perimeter of the opening 7 of the container body 6.

In this manner, the peripheral portion 5, which isolates the user 8 from contact with the toilet bowl 3, and the membrane 10, with the anti-odor function, are made of a material that is designed to dissolve rapidly, once in water, while the central portion 4, which has to collect and wrap the feces, is designed to dissolve completely only after the hygienic protector 1 has reached the septic tank, thus withholding the miasmas generated by the feces until these reach the septic tank.

In particular, FIG. 5 schematically shows the hygienic protector 1 not yet opened, with the laterally protruding portions 54, i.e. the side flaps 54, still facing each other, while FIG. 5*a* shows the opened hygienic protector 1, with the side flaps 54 opened, seen from above and ready to be applied, in any angular position, on the toilet seat.

According to a first variation of the first embodiment, which is schematically illustrated in FIGS. 6 and 6*a*, only the anti-odor membrane 10 is made of a material that is water-soluble, biodegradable and heat-sensitive, which is to say, a material that is rapidly water-soluble, while the central portion 4 and the peripheral portion 5 are made of the same type of material, water-soluble and biodegradable, but slowly water-soluble.

In this case, the edges of the anti-odor membrane 10 are bonded to the edges of the opening 7 of the container body 6.

The method for providing the hygienic protector 1 illustrated in FIGS. 6 and 6*a* comprises the steps of:

- arranging two first sheets made of a water-soluble and biodegradable material, mutually superimposed;
- cutting such two first sheets so as to define the central portion 4 and the peripheral portion 5;
- arranging a second sheet made of a water-soluble, biodegradable and heat-sensitive material;
- cutting the second sheet so as to provide the anti-odor membrane 10;
- mutually bonding the two first sheets along the edges of the central portion 4 so as to define the container body 6;
- bonding the edges of the anti-odor membrane 10 along the perimeter of the opening 7 of the container body 6.

FIGS. 7 and 7*a* show a second variation of the first embodiment of the hygienic protector 1, in which there are two anti-odor membranes 10 and 11. Such hygienic protector 1 is preferably provided by first bonding the anti-odor membrane 11 to the side walls of the container body 6 and then bonding the anti-odor membrane 10 along the edges of the opening 7 of the container body 6.

The two anti-odor membranes 10 and 11 are configured to convey the expanding gas originating from the solid excrement into two different volumes 13 and 14, further decreasing the spread of the unpleasant odor generated by the excrement to the external environment.

FIGS. 8, 8*a* and 9 show two different variations of a second embodiment of the hygienic protector 1. The two variations shown respectively in FIGS. 8 and 8*a*, and in FIG. 9, differ in that the second variation comprises two anti-odor membranes 10 and 11. With respect to the first embodiment, the second embodiment of the hygienic protector 1 has even greater dimensions, which are such as to enable it to cover the toilet bowl 3 in an even more extended manner, and in particular the rear parts thereof, where the user 8 rests, or risks resting, his/her back 82, and the front parts thereof, where the user rests, or risks resting, his/her legs 81.

In particular, the hygienic protector 1 according to the second embodiment is configured to abundantly cover at least the lower part of the lid 15 of the toilet bowl 3.

FIGS. 10 and 10*a* show a third embodiment of the hygienic protector 1. According to the third embodiment, the hygienic protector 1 is configured to partially cover the seat surface of the toilet bowl 3. Such hygienic protector 1 is in fact applied to the toilet bowl 3 so that only the front part 55 of the peripheral portion 5 covers, in an upper region, the front edge of the toilet bowl 3, or more specifically of the toilet seat 17. The only partial covering of the sitting portion of the toilet bowl 3 is particularly adapted to the use of the hygienic protector 1 in a domestic environment, where complete isolation of the user 8 from contact with parts of the toilet bowl 3 is considered superfluous.

FIGS. 11 and 11*a* show the fourth embodiment of the hygienic protector 1, which is configured in particular for use in bedpans for urine and feces, in which only the container body 6 is intended to be inserted in the bedpan, or it is designed to be applied to pots for children.

In all the embodiments, the hygienic protector 1 can be provided 90% in a material that is rapidly water-soluble and the remaining 10% in a material that is slowly water-soluble. This is a direct consequence of the fact that the sole portion of the hygienic protector 1 that is made of a slowly water-soluble material is only the central portion 4 which defines the container body 6 of the feces.

As illustrated in FIG. 12, the hygienic protector 1 can be comprised in a hygienic kit 100. The hygienic kit 100 advantageously comprises an envelope 101, containing the hygienic protector 1, a sanitary wipe 102 and a plurality of sheets of toilet paper 103. Advantageously, the envelope 101, the sanitary wipe 102 and the toilet paper 103 are also made of a material that is water-soluble and biodegradable, and are designed to be disposed of inside the toilet bowl 3 and in the septic tank.

The operation of the hygienic protector, according to the invention, is clear and evident from the foregoing description.

The hygienic protector 1 can be supplied to the user 8, folded repeatedly on itself, inside the envelope 101 of the travel kit 100.

The user 8 takes out the hygienic protector 1, unfolds it, and applies it to the toilet bowl 3, with the container body 6 inside the toilet bowl 3. The user 8 can apply the hygienic protector in any angular position with respect to the toilet bowl 3, in that the extension of the peripheral portion 5 is such as to cover the toilet seat 17 in any case.

When the user 8 urinates, the jet of urine is such as to create holes in the material of the hygienic protector 1, which will favor the correct expulsion of air that may be trapped in the container body 6 at the moment of disposal into the septic tank, by way of the flow of water.

The feces that are expelled by the user 8 determine the puncturing of the anti-odor membrane 10 and are collected on the bottom 60 of the container body 6, in particular at one of the two V-shaped profiles 61 or 62.

At this point, the heat of the feces is such as to determine a contraction of the heat-shrink material from which the container body 6 is made, to the point that the feces are at least partially wrapped by the walls of such container body 6. The feces are thus isolated both from the external environment and from contact with the internal surfaces of the toilet bowl 3, since they are contained in the container body 6.

When the user 8 has finished using the toilet, he/she allows the hygienic protector 1 to fall into the water present in the toilet bowl 3.

As soon as the hygienic protector 1 is immersed in water the dissolving process begins, which will be very fast for the anti-odor membrane 10 and the peripheral portion 5 of the hygienic protector 1 if made of a rapidly water-soluble material, and will be slower for the central portion 4 that defines the container body 6, which preferably has to remain sufficiently intact for an interval of time that is such as to allow the container body 6 to reach the septic tank. Inside the septic tank, within a few minutes, the central portion 4 that defines the container body 6 will dissolve completely as well. As soon as the hygienic protector 1 comes into contact with the water present in the toilet bowl 3, all of the components thereof that are made of a rapidly water-soluble material, which can constitute up to 90% of the total material from which the hygienic protector 1 is made, will dissolve almost immediately. In this manner, the flow of water activated by the user 8 has to dispose of only the part of central portion 4 that has not yet dissolved in water, although it has already been at least partially reduced in volume and it has already begun to soften, passing from a solid consistency to a viscous consistency.

In addition to this, since the container body 6 not only has a function to separate the feces, but also a function to collect them, in that it routes them and conveys them to the apex of the V-shaped profile 61, 62, the expulsion of the feces into the septic tank is favored, in that the feces, collected and retained by the container body 6, once in the water, do not tend to spread out. In this manner a reduced flow of water is sufficient in order to flush the feces into the septic tank, through the drain hole of the toilet bowl 3.

In practice it has been found that the hygienic protector, particularly for the collection and separation of human solid excrement, according to the present invention, achieves the intended aim and objects in that it makes it possible to safeguard the intimate parts of users and also the hygiene and cleanliness of toilet bowls.

Another advantage of the hygienic protector, according to the invention, consists in that it is able to completely isolate the user from accidental contact with the toilet bowl and from any bothersome splashes of dirty water.

Another advantage of the hygienic protector, according to the invention, consists in that it retains the unpleasant odors that are generated by the solid excrement upon contact with air, and thus it keeps the surrounding environment healthy without having to resort to wasteful electrical ventilation apparatuses.

Another advantage of the hygienic protector, according to the invention, consists in that it is easily adaptable to the various different types of toilet bowl and bedpans, as well as to all types of users, independently of their size.

Another advantage of the hygienic protector, according to the invention, consists in that it reduces the volume of water required, in respect of current toilet bowls, for the disposal of the feces, since they are concentrated in a well-defined region of the container body, and are held there until they reach the septic tank.

Another advantage of the hygienic protector, according to the invention, consists in that it avoids the use of chemical products, generally aggressive towards the environment, which are necessary for cleaning the surfaces of toilet bowls or of bedpans for urine and feces.

The hygienic protector thus conceived is susceptible of numerous modifications and variations, all of which are within the scope of the appended claims.

Moreover, all the details may be substituted by other, technically equivalent elements.

In practice the materials employed, provided they are compatible with the specific use, and the contingent dimensions and shapes, may be any according to requirements.

Where the technical features mentioned in any claim are followed by reference numerals and/or signs, those reference numerals and/or signs have been included for the sole purpose of increasing the intelligibility of the claims and accordingly, such reference numerals and/or signs do not have any limiting effect on the interpretation of each element identified by way of example by such reference numerals and/or signs.

The invention claimed is:

1. A hygienic protector (1) configured to be at least partially inserted into an opening (2) of a toilet bowl (3), comprising:

a central portion (4) and a peripheral portion (5), said central portion (4) defining a container body (6) for the collection and treatment of human solid excrement, said peripheral portion (5) configured to protrude externally from an edge of said opening (2) of said toilet bowl (3), said central portion (4) and said peripheral portion (5) comprising a water-soluble and biodegradable material;

said container body (6) comprising an opening (7) corresponding in shape to said opening (2) of said toilet bowl (3); and at least one anti-odor membrane (10, 11) extending over said central portion (4), so as to close said opening (7) of said container body (6), said at least one anti-odor membrane (10, 11) comprising a water-soluble, biodegradable, and heat-sensitive material adapted to puncture upon contact with said human solid excrement at an area of contact between said at least one anti-odor membrane (10, 11) and said human solid excrement.

2. The hygienic protector (1) according to claim 1, wherein the water-soluble and biodegradable material of said central portion (4) is adapted to dissolve completely in water in a longer time than a time required for the water-soluble, biodegradable, and heat-sensitive material of said at least one anti-odor membrane (10, 11) or said water-soluble and biodegradable material of said peripheral portion (5) to completely dissolve.

3. The hygienic protector (1) according to claim 1, characterized in that the water-soluble, biodegradable, and heat-sensitive material of said at least one anti-odor membrane (10, 11) is completely soluble in water at a water temperature of at least 10° C.

4. The hygienic protector (1) according to claim 1, characterized in that the water-soluble and biodegradable material of said central portion (4) is completely soluble in water at a water temperature of at least 40° C.

5. The hygienic protector (1) according to claim 1, characterized in that the water-soluble, biodegradable, and heat-sensitive material of said at least one anti-odor membrane (10, 11) has a thickness of between 10 and 30 micrometers.

6. The hygienic protector (1) according to claim 1, characterized in that the water-soluble and biodegradable material of said central portion (4) has a thickness of between 30 and 50 micrometers.

7. The hygienic protector (1) according to claim 1, characterized in that the water-soluble and biodegradable material of said central portion (4) is configured to dissolve completely in water in a time interval of between 3 and 15 minutes, at a water temperature of at least 10° C.

8. The hygienic protector (1) according to claim 1, characterized in that the water-soluble, biodegradable, and heat-sensitive material of said at least one anti-odor membrane (10, 11) is configured to dissolve completely in water in a time interval of between 5 and 120 seconds, at a water temperature of at least 10° C.

9. The hygienic protector (1) according to claim 1, characterized in that the water-soluble and biodegradable material of said central portion (4) is made of a heat-shrink material, so that the surface of said central portion (4), upon contact with said human solid excrement, contracts and wraps at least partially around said human solid excrement.

10. The hygienic protector (1) according to claim 1, characterized in that said peripheral portion (5) is configured to completely cover a seat surface of said toilet bowl (3), in a plurality of angular positions assumed by said hygienic protector (1) with respect to said toilet bowl (3).

11. The hygienic protector (1) according to claim 1, characterized in that said peripheral portion (5) is configured to completely cover a seat surface of said toilet bowl (3), said peripheral portion (5) comprising a portion protruding from a front of said toilet bowl (3), and a portion for protruding from a rear of said toilet bowl (3).

12. The hygienic protector (1) according to claim 1, characterized in that said at least one anti-odor membrane (10, 11) comprises a hole (12) through which said human solid excrement may pass.

13. The hygienic protector (1) according to claim 1, characterized in that said central portion (4) and said anti-odor membrane (10, 11) are made of a material configured to puncture upon contact with urine, thereby creating puncture holes, the puncture holes generated upon contact with the urine allowing an outflow of air from the inside to the outside of said container body (6).

14. The hygienic protector (1) according to claim 1, characterized in that the central part of said at least one anti-odor membrane (10, 11) is adapted to be arranged at a depth of between 5 and 15 centimeters with respect to a seat surface of said toilet bowl (3).

15. The hygienic protector (1) according to claim 1, wherein the at least one anti-odor membrane comprises two membranes (10, 11), said two membranes extending over said central portion (4), to close said opening (7) of said container body (6), said two membranes (10, 11) lying on two planes that are mutually parallel.

16. The hygienic protector (1) according to claim 1, wherein the container body includes a bottom (60), the bottom including, in cross-section, at least one V-shaped profile (61 , 62), which is configured to collect said human solid excrement at an apex of said at least one V-shaped profile.

17. The hygienic protector (1) according to claim 1, characterized in that the hygenic protector is adapted to be reduced by 90% upon contact with water, with only a remaining 10% of the hygenic protector constituting said central part (4).

18. The hygienic protector (1) according to claim 1, further including an envelope (101) for containing said hygienic protector (1), a sanitary wipe (102) and a plurality of sheets of toilet paper (103).

19. A method for providing a hygienic protector (1) configured to be at least partially inserted into an opening (2) of a toilet bowl (3), comprising the steps of:

providing first and second sheets of a water-soluble, biodegradable and heat-sensitive material, in a mutually superimposed relationship;

cutting said first and second sheets so as to define a peripheral portion (5) configured to protrude externally from an edge of the opening (2) of the toilet bowl (3), and to further provide an anti-odor membrane (10, 11);

providing a third sheet made of a water-soluble and biodegradable material;

cutting and bonding said third sheet so as to provide a central portion (4), said peripheral portion (5) and said central portion (4) forming a container body (6) for the collection and treatment of human solid excrement, wherein the container body (6) includes an opening (7) corresponding in shape to the opening (2) of the toilet bowl (3); and bonding edges of said anti-odor membrane (10, 11) along a perimeter of the opening (7) of said container body (6) such that the anti-odor membrane (10, 11) extends over the central portion (4) so as to close the opening (7) of the container body (6).

20. A method for providing a hygienic protector (1) according to claim 1, comprising the steps of:

providing first and second sheets made of the water-soluble and biodegradable material, in a mutually superimposed relationship;

cutting said first and second sheets so as to define said central portion (4) and said peripheral portion (5);

providing a third sheet made of the water-soluble, biodegradable and heat-sensitive material;

cutting said third sheet so as to provide said at least one anti-odor membrane (10, 11);

mutually bonding said first and second sheets along edges of said central portion (4) so as to define said container body (6);

bonding edges of said anti-odor membrane (10, 11) along a perimeter of the opening (7) of said container body (6).

* * * * *